United States Patent [19]

Paulet et al.

[11] Patent Number: 5,052,635

[45] Date of Patent: Oct. 1, 1991

[54] SYSTEM FOR THE RECEPTION OF GUIDANCE COMMANDS FOR A GUIDED MISSILE IN OPTOELECTRONIC MODE

[75] Inventors: Marc Paulet, Courbevoie; Alain Pérès, Fontenay aux Roses, both of France

[73] Assignee: Thomson-CSF, Puteaux, France

[21] Appl. No.: 619,972

[22] Filed: Nov. 30, 1990

[30] Foreign Application Priority Data

Dec. 8, 1989 [FR] France ..... 89 16261

[51] Int. Cl.[5] ..... F41G 7/26

[52] U.S. Cl. ..... 244/3.11

[58] Field of Search ..... 244/3.11, 3.13

[56] References Cited

U.S. PATENT DOCUMENTS 3,416,751 12/1968 Larson ..... 244/3.13
4,354,419 10/1982 Patterson ..... 244/3.1
4,696,441 9/1987 Jones et al. ..... 244/3.13

FOREIGN PATENT DOCUMENTS 1467196 12/1966 France .
930961 7/1963 United Kingdom .

*Primary Examiner*—Charles T. Jordan
*Attorney, Agent, or Firm*—Oblon, Spivak, McClelland, Maier & Neustadt

[57] ABSTRACT

A system for the reception of guidance orders for a guided missile in optoelectronic mode includes an optoelectronic sensor receiving a guidance signal, transmitted by an optical beam, from a firing control station. There is provided an unpropelled aerodynamic carrier (1) connected to the body of the missile by a flexible link (7), enabling it to be pulled by the missile during the propulsion phase of this missile. The assembly is configured so that, under the effect of this traction, the aerodynamic carrier takes an angle of attack ($\alpha$) enabling it, in a transversal direction, to move away from the body of the missile by a distance (x) greater than the extent of a zone (4) in which the transmission of the beam is disturbed by the hot gas jets from the propellant of the missile. The aerodynamic carrier is provided, at its rear end, pointed in the direction of attack of the optical beam, with an optical transducer capable of picking up the optical guidance signal transmitted by this beam (3). The flexible link (7) preferably includes an optical fiber, optically coupled at one of its ends to the transducer positioned on the aerodynamic carrier, so as to inject the optical signal received by this transducer into the fiber. At its opposite end, this optical fiber is optically coupled to the optoelectronic sensor (2) positioned in the body of the missile, so that this sensor receives, from the fiber, the received optical signal injected into said fiber at its other end, and converts this received optical signal into an electrical guidance signal.

8 Claims, 1 Drawing Sheet

SYSTEM FOR THE RECEPTION OF GUIDANCE COMMANDS FOR A GUIDED MISSILE IN OPTOELECTRONIC MODE

BACKGROUND OF THE INVENTION

1. Field of the Invention

The present invention relates to systems for the reception of guidance commands for missiles, such as ground-to-air missiles, guided in optoelectronic mode, i.e. for missiles receiving guidance data, transmitted by means of laser beams, from remote firing control stations.

The term "guidance" shall be understood in its widest sense, i.e. as covering beam-riding guidance or simple remote control, in which the guidance is done by following the beam, as well as the off-beam guidance modes (sometimes designated by the term "remote control" in its strictest sense) wherein the beam is not followed, in which case the missile firing control and target firing control directions are not colinear.

2. Description of the Prior Art

The wavelengths used for the transmission of a guiding control signal in optoelectronic mode are optical wavelengths, typically in the infrared range (wavelengths generally between 12 μm and 0.8 μm) in contrast with the signals transmitted by using wavelengths in the radio-frequency range.

When optoelectronic guidance is used, there is the problem of disturbances introduced by the hot gas jets of the missile during its propulsion phase.

During this propulsion phase, the hot gas jets may produce disturbances capable of significantly affecting the guiding infrared beam that goes through the hot gas jets and the surrounding zone. This problem relates to direct disturbances (infrared emission proper to the propellant) as well as indirect disturbances (turbulence created in the environment producing variations in the refraction index, absorption and scattering of the beam by smoke etc.).

These disturbances, notably atmospheric disturbances, appear throughout the band of the usable wavelengths. To reduce the influence of these disturbances to the minimum, it is therefore necessary to move the sensors away, transversally, as far as possible from the axis of the missile, and hence from the axis of the hot gas jets.

FIG. 1 shows a missile, provided with infrared sensors 2 receiving an optical signal conveyed by a beam 3. To prevent the disturbances in a zone 4 around the hot gas jets from the propellant, the sensors 2 are generally mounted at the ends of fins or control surfaces 5 of the missile.

However, notably for reasons of convenience of storage, the span of the fins or control surfaces of present-day missiles is generally reduced to the minimum. This therefore means that the transversal distance obtained by positioning these sensors at the end of a fin or control surface will be always small and, in practice, inadequate.

One of the aims of the invention is to propose a system enabling the receivers to be moved away to a greater distance from the hot gas jets of the missile while, at the same time, causing the least possible disturbance to the aerodynamic characteristics of this missile.

This latter condition especially rules out the use of telescopic rods or similar devices, at the end of which the sensor would be placed.

In effect, in view of the high speeds (over Mach 3) of modern missiles, the bending stresses exerted on such rods owing to their inherent drag would be such that only thick rods could withstand these stresses. Owing to their inherent drag, these rods would then substantially influence the aerodynamic characteristics of the missile.

To resolve this difficulty, the present invention proposes, essentially, the removal to a distance, by aerodynamic effect, of the optical transducer or transducers, by mounting the sensor on an aerodynamic carrier designed so as to move away from the body of the missile, at least during the propulsion phase of this missile.

SUMMARY OF THE INVENTION

More precisely, the invention proposes a system for the reception of guidance commands for a guided missile, including at least one optoelectronic sensor receiving a guidance signal, transmitted by an optical beam, from a remote firing control station, wherein said system includes at least one unpropelled aerodynamic carrier, connected to the body of the missile by a flexible link, enabling it to be pulled by the missile during its flight. The assembly is configured so that, under the effect of this traction, the aerodynamic carrier takes an angle of attack enabling it, in a transversal direction, to move away from the body of the missile by a distance greater than the extent of the zone in which the transmission of the beam is disturbed by the hot gas jets from the propellant of the missile; and this aerodynamic carrier is provided, at its rear end, pointed in the direction of attack of the optical beam, with an optical transducer capable of picking up the optical guidance signal transmitted by this beam.

Very advantageously, said flexible link includes an optical fiber, optically coupled at one of its ends to the tranducer positioned on the aerodynamic carrier, so as to inject the optical signal received by this transducer into the fiber. At its opposite end, this optical fiber is optically coupled to the optoelectronic sensor positioned in the body of the missile, so that this sensor receives, from the fiber, the received optical signal injected into said fiber at its other end, and converts this received optical signal into an electrical signal.

Preferably, the flexible link is then formed by an optical fiber that is mechanically and thermally reinforced by sheathing, the tractive force being then essentially transmitted by the sheath of the fiber.

According to one embodiment, the point of application of the tractive force exerted by the flexible link is offset transversally in relation to the body of the aerodynamic carrier by the interposition of an intermediate element, so as to increase the moment of this tractive force with respect to the center of gravity of the aerodynamic carrier and thus increase the angle of attack taken by it under the effect of the traction.

Preferably, for aerodynamic uniformity and to improve the signal-to-noise ratio, this system includes a plurality of identical aerodynamic carriers, positioned in an axially symmetrical manner around the body of the missile.

BRIEF DESCRIPTION OF THE DRAWINGS

Other features and advantages of the invention will appear from the following detailed description, given with reference to the appended drawings.

The above-mentioned

DETAILED DESCRIPTION OF THE INVENTION

Figure 1:
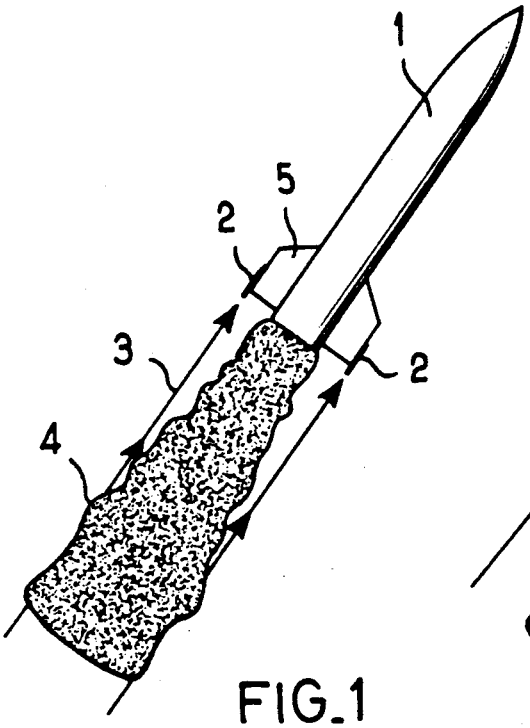
FIG. 1 PRIOR ART
FIG. 1 shows a missile in a propulsion phase, fitted out with a system for the reception of guidance commands according to the prior art.
Figure 2:
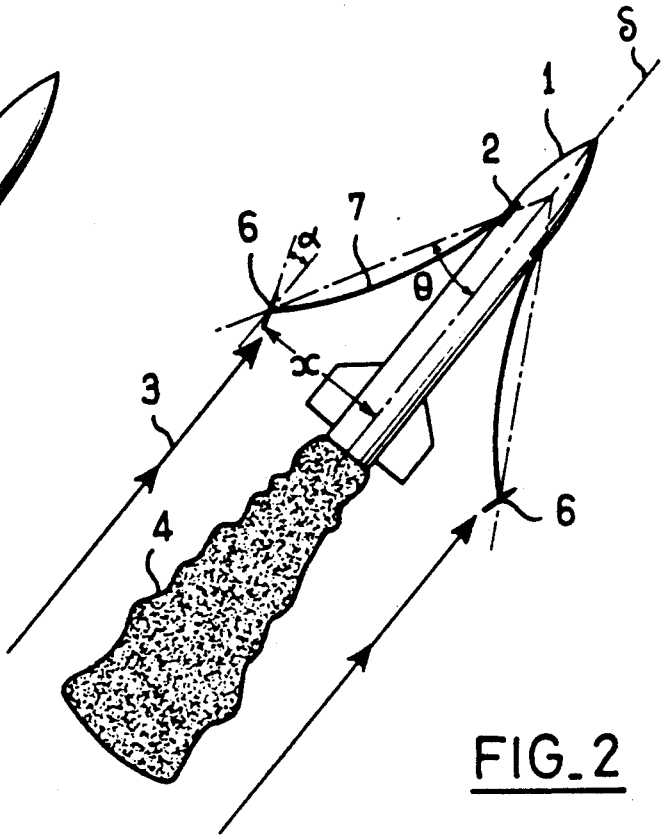
FIG. 2 is homologous to FIG. 1, for the system for the reception of guidance commands according to the invention.

As illustrated in FIG. 2, at least one aerodynamic carrier 6, pulled at the end of a flexible link 7, is added to the missile 1.

Preferably, for the uniformity of the overall aerodynamic characteristics and to improve the signal-to-noise ratio of the picked-up signal, there is provision for two diametrically opposite carrier/connection assemblies, but this number and this configuration are not restrictive.

For the transducer 9, it is also possible to use a component (optoelectronic sensor) directly converting the optical guidance signal (beam 3) into an electrical signal and transmitting this electrical signal to the steering computer within the missile, through an electrical wire link.

However, for the transducer 9, it is preferred to use a purely optical transducer having the sole function of sensing the infrared wave of the beam through a focusing lens and of injecting this signal into an optical fiber which would then constitute the flexible link 7.

The optoelectronic sensor 2 is positioned at the other end of this optical fiber 7, in the body of the missile. This optoelectronic sensor 2 will receive, at input, the signal injected into the fiber and will deliver, at output, an electrical signal to the steering computer of the missile. The optoelectronic sensor could be a standard infrared sensor of the same type as those used in present-day missiles.

Figure 3:
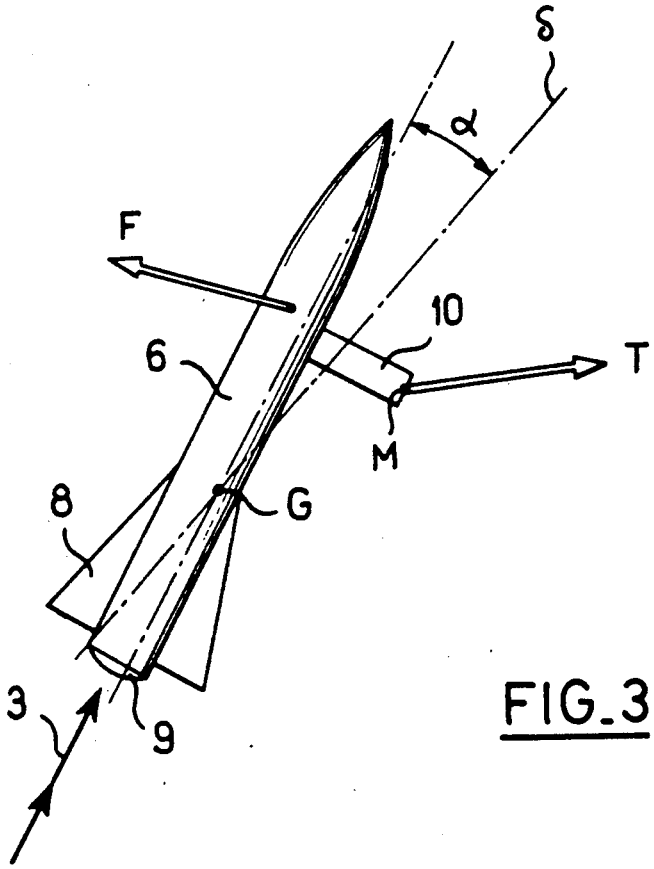
FIG. 3 is a more detailed view of one of the aerodynamic carriers 6 which can be seen in FIG. 2.

The aerodynamic carrier, shown in greater detail in FIG. 3, may take a variety of shapes, for example the shape of a dihedron (the carrier will then take a preferred plane of orientation) or else, as shown, the same shape as the missile but on a reduced scale, i.e. with a cylindrical body that has an ogival end and is provided with appropriate stabilization means, for example a skirt or, as shown, fins 8.

It is important for the aerodynamic carrier to be as small-sized as possible so as to disturb the overall aerodynamic characteristics of the missile as little as possible.

Typically, the diameter of the aerodynamic carrier (its caliber) could be of the order of 1 cm. This would make it possible to house a standard type of optical transducer 9 therein, in the rear part. This optical transducer 9 could have, for example, a diameter of less than 1 cm with a reception field having an aperture of the order of 30°.

The shape of the aerodynamic carrier will be computed so that, under the effect of the traction of the flexible link 7, it takes a certain angle of attack $\alpha$ with respect to the direction $\delta$ of the axis of the missile, thus moving away by a distance x (FIG. 2) from the axis of the missile, away from the disturbed zone 4.

To determine the characteristics of the aerodynamic carrier, first of all, a balance will be drawn up of the forces and moments that are applied to it, under the effect of:

the traction force T exerted by the fiber;

the aerodynamic lift F, exerted on the center of thrust of the aerodynamic carrier, and inertial forces, taking account of the acceleration communicated to the assembly.

Having thus determined the configuration of equilibrium, it is possible to determine the fiber length necessary to obtain the desired angular distance $\theta$ and transversal distance x.

In view of the high speeds, it may be necessary to take account of the inherent drag of the wire (its drag per unit of length is never zero). It is shown then that this wire, under the effect of the velocity, takes the form of a parabola arc.

To accentuate the phenomenon and make the aerodynamic carrier take a greater angle of attack $\alpha$, it is possible, instead of applying the traction of the fiber directly to the body of the aerodynamic carrier, to apply it via an intermediate element 10, for example a rigid rod, the positioning and length of which will be computed so as to increase the resultant moment of the traction force exerted by the fiber on the center of gravity G, in moving away the center of thrust.

As regards the fiber, a sheathed fiber will be chosen for reasons of mechanical and thermal protection and so that the traction is exerted essentially by the sheath and not by the core of the fiber, with as small a diameter as possible, it being necessary to seek a compromise between the highest possible mechanical strength and drag reduced to the minimum. Typically, the total diameter of the sheathed fiber could be smaller than 1 mm. Besides, the link should be thin enough to work chiefly in traction alone, in reducing any bending stress that may result from the inherent stiffness of the sheathed fiber to the minimum. The length of the fiber will depend on the length of the missile and on its flight conditions.

The general working of the system is as follows:

in the propulsion phase, the velocity of the missile increases and the aerodynamic carrier then takes an angle of attack creating lift;

it moves away from the body of the missile, so that the disturbances from the hot gas jets have only very little effect on the signal received by the optical transducer that it carries;

the guidance station on the ground then sends a guidance command by laser; this command is picked up by the transducer and injected by it into the fiber;

the signal is propagated in the fiber and it is converted at output of the fiber into an electrical signal by the optoelectronic sensor 2 (this is a standard conversion of an optical signal into an electrical signal);

the missile then carries out the guidance command transmitted.

What is claimed is:

1. A system for the reception of in-flight guidance commands for a missile, the missile including an axial central part forming a body and, as the case may be, fins and control surfaces, and being propelled during its flight, in the course of phases known as propulsion phases, by a jet of hot gases defining a zone of turbulence behind the missile, said zone having a symmetry of revolution along the axis of the missile, the biggest radius of this zone having a value smaller than a value x, guidance commands being transmitted by a remote firing control station by means of an optical beam to at least one optical transducer linked to the missile, wherein the reception system includes at least one optical transducer carrier linked to the body of the missile by a flexible link and the carrier includes means cooperating with the flexible link to hold said carrier at a distance from the axis of the missile equal to the value x at least during the propulsion phases of the missile.

2. A system according to claim 1 for the reception of guidance commands, wherein the flexible link includes an optical fiber having two ends, one coupled optically to the transducer and the other coupled optically to an optoelectronic sensor positioned in the body of the missile.

3. A system according to claim 2 for the reception of guidance commands, wherein the optical fiber constituting said flexible link is mechanically and thermally reinforced by sheathing.

4. A system according to claim 1 for the reception of guidance commands, wherein the carrier is constituted by a cylindrical body with an ogival front end, and wherein the means cooperating with the flexible link are constituted by fins.

5. A system according to claim 1, wherein the diameter of the cylindrical body of the carrier is of the order of one cm.

6. A system according to claim 4, wherein the carrier includes a rigid transversal rod having two ends, the first end being connected to the cylindrical body of the carrier and the second end being connected to the flexible link.

7. A system according to claim 5, wherein the carrier includes a rigid transversal rod having two ends, the first end being connected to the cylindrical body of the carrier and the second end being connected to the flexible link.

8. A system according to claim 1, including a plurality of flexible links and identical carriers, positioned in an axially symmetrical manner around the body of the missile.

* * * * *